US006962440B2

(12) United States Patent
Fenzl et al.

(10) Patent No.: US 6,962,440 B2
(45) Date of Patent: Nov. 8, 2005

(54) MOLDED SLIDERS FOR ACTUATING ZIPPERS IN RECLOSABLE PACKAGES

(75) Inventors: Eric J. Fenzl, Loganville, GA (US); Basil C. Linton, Loganville, GA (US); Gregory H. Crunkleton, Nicolson, GA (US)

(73) Assignee: Illinois Tool Works Inc., Glenview, IL (US)

( * ) Notice: Subject to any disclaimer, the term of this patent is extended or adjusted under 35 U.S.C. 154(b) by 41 days.

(21) Appl. No.: 10/412,438

(22) Filed: Apr. 11, 2003

(65) Prior Publication Data

US 2004/0161169 A1 Aug. 19, 2004

Related U.S. Application Data

(63) Continuation-in-part of application No. 10/367,450, filed on Feb. 14, 2003.

(51) Int. Cl.[7] ..... B65D 33/16
(52) U.S. Cl. ..... 383/64; 24/399
(58) Field of Search ..... 383/64; 24/399–400, 24/430

(56) References Cited

U.S. PATENT DOCUMENTS 3,660,875 A * 5/1972 Gutman ..... 24/400
5,836,056 A * 11/1998 Porchia et al. ..... 24/400
5,956,815 A 9/1999 O'Connor et al.
6,088,887 A 7/2000 Bois
6,161,271 A 12/2000 Schreiter
6,178,602 B1 * 1/2001 Burke et al. ..... 24/30.5 R
6,199,256 B1 3/2001 Revnew et al.
6,287,000 B1 9/2001 Buchman
6,287,001 B1 9/2001 Buchman
6,306,071 B1 10/2001 Tomic
6,364,530 B1 4/2002 Buchman
6,477,821 B1 11/2002 Bois
6,490,769 B2 * 12/2002 Siegel ..... 24/415
D469,721 S * 2/2003 Buchman ..... D11/221
6,575,628 B1 * 6/2003 Borchardt et al. ..... 383/64
6,611,996 B2 * 9/2003 Blythe et al. ..... 24/399
6,780,146 B2 * 8/2004 Thomas et al. ..... 493/213

* cited by examiner

*Primary Examiner*—Jes F. Pascua
(74) *Attorney, Agent, or Firm*—Ostrager Chong Flaherty & Broitman P.C.

(57) ABSTRACT

A slider-zipper assembly in which the slider has a design lending itself to economical manufacture using an injection molding process. The slider comprises a frame that straddles the zipper, a plow supported by the frame and separating respective sections of two interlockable profiled zipper parts, and a plurality of projections that latch under the zipper parts to retain the slider on the zipper. The frame has three bridging members, a first opening disposed between the first and second bridging members, and a second opening disposed between the second and third bridging members, the plow being connected to and depending downward from the second bridging member. First and second retaining projections are disposed entirely under the first opening with no portion of the first and second bridging members overhanging any portion thereof, and third and fourth retaining projections are disposed entirely under the second opening with no portion of the second and third bridging members overhanging any portion thereof.

23 Claims, 10 Drawing Sheets

MOLDED SLIDERS FOR ACTUATING ZIPPERS IN RECLOSABLE PACKAGES

RELATED PATENT APPLICATION

This application is a continuation-in-part of and claims priority from U.S. patent application Ser. No. 10/367,450 filed on Feb. 14, 2003 and entitled "Reclosable Packaging Having Slider-Operated String Zipper".

BACKGROUND OF THE INVENTION

This invention generally relates to zippers for use in reclosable packaging, such as bags or pouches. In particular, the invention relates to string zippers for reclosable bags.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage. In one type of slider-operated zipper assembly, the slider straddles the zipper and has a separating finger or plow that is inserted between the profiles to force them apart as the slider is moved along the zipper in an opening direction. The closing end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Previous slider-operated, separately extruded zippers used flange-type constructions.

An alternative zipper design is the so-called flangeless or string zipper, which has no flange portion above or below the interlockable closure profiles. In the case of a string zipper, the bag making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

In conjunction with the economic manufacture of the zipper, the slider needs to be manufactured with minimal cost. A known technique for manufacturing sliders is injection molding, which involves the injection of molten plastic into a cavity formed by mold tooling, curing the plastic, and removal of the cured plastic from the mold cavity. By minimizing the number of parts making up the mold tooling, sliders can be molded at maximal speed. There is a continuing need of new designs for sliders that can be manufactured at low cost.

BRIEF DESCRIPTION OF THE INVENTION

The present invention is directed to sliders with separating fingers or plows that can be manufactured economically. The sliders are designed so that they can be formed in a mold that requires no more than two parts to form a cavity having the geometric shape of the slider. This speeds up the manufacturing process, which would comprise the following steps: closing the mold; injecting molten plastic into the mold cavity; curing the plastic; opening the mold; and then removing the molded slider from the mold cavity. The slider is designed so that there are no confronting horizontal interior surfaces, the axis of the plow being considered the vertical direction for reference purposes. The absence of confronting horizontal interior surfaces eliminates the need for a third mold part that would be inserted sideways between the first and second mold parts.

One aspect of the invention is a slider comprising: first and second side walls spaced apart to define a passageway therebetween; a first cross beam connecting the first side wall to the second side wall and disposed at one end of the slider; a second cross beam connecting the first side wall to the second side wall and spanning the passageway in a zone intermediate to the ends of the slider; a plow connected to and depending from the second cross beam, the plow partitioning the passageway in the intermediate zone of the slider; a first retaining ledge projecting from the first side wall into the passageway; and a second retaining ledge projecting from the second side wall into the passageway, wherein a cutout in the top of the slider communicates with the passageway, the cutout being bounded at least in part by respective portions of the first and second side walls and the first and second cross beams. The first and second retaining ledges are disposed entirely under the cutout with no portion of the first and second cross beams overhanging any portion of the first and second retaining ledges.

Another aspect of the invention is a slider comprising: first and second side walls; first, second and third bridging members each having first and second ends, the first ends of the first, second and third bridging members being connected to the first side wall, and the second ends of the first, second and third bridging members being connected to the second side wall, the first, second and third members generally lying in the same plane with the second bridging member disposed between the first and third bridging members, and the first and second side walls both depending downward generally perpendicular to the plane, wherein a first cutout is bounded at least in part by the first and second side walls and the first and second bridging members, while a second cutout is bounded at least in part by the first and second side walls and the second and third bridging members; a generally central plow disposed between the first and second side walls, the plow being connected to and depending downward from the second bridging member; first and second retaining ledges connected to the first side wall and projecting toward the second side wall; and third and fourth retaining ledges connected to the second side wall and projecting toward the first side wall. The first and third retaining ledges are disposed entirely under the first cutout with no portion of the first and second bridging members overhanging any portion of the first and third retaining ledges, while the second and fourth retaining ledges are disposed entirely under the second cutout with no portion of the second and third bridging members overhanging any portion of the second and fourth retaining ledges.

A further aspect of the invention is an assembly comprising a zipper and a slider that actuates the zipper, the zipper comprising interlockable first and second profiled zipper parts, and the slider comprising a frame that straddles the zipper, a plow supported by the frame and separating respective sections of the first and second zipper parts, and a plurality of projections that latch under the first and second zipper parts to retain the slider on the zipper, wherein the frame comprises first, second and third bridging members, a first opening disposed between the first and second bridging members, and a second opening disposed between the second and third bridging members, the plow being connected to and depending downward from the second bridging member. First and second projections of the plurality of projections are disposed entirely under the first opening with no portion of the first and second bridging members overhanging any portion of the first and second retaining projections, and third and fourth projections of the plurality of projections are disposed entirely under the second opening with no portion of the second and third bridging members overhanging any portion of the third and fourth projections.

Further aspects of the invention include a reclosable package incorporating the slider-zipper assembly described in the immediately preceding paragraph, as well as reclosable packages incorporating the sliders described in the two paragraphs preceding the immediately preceding paragraph.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
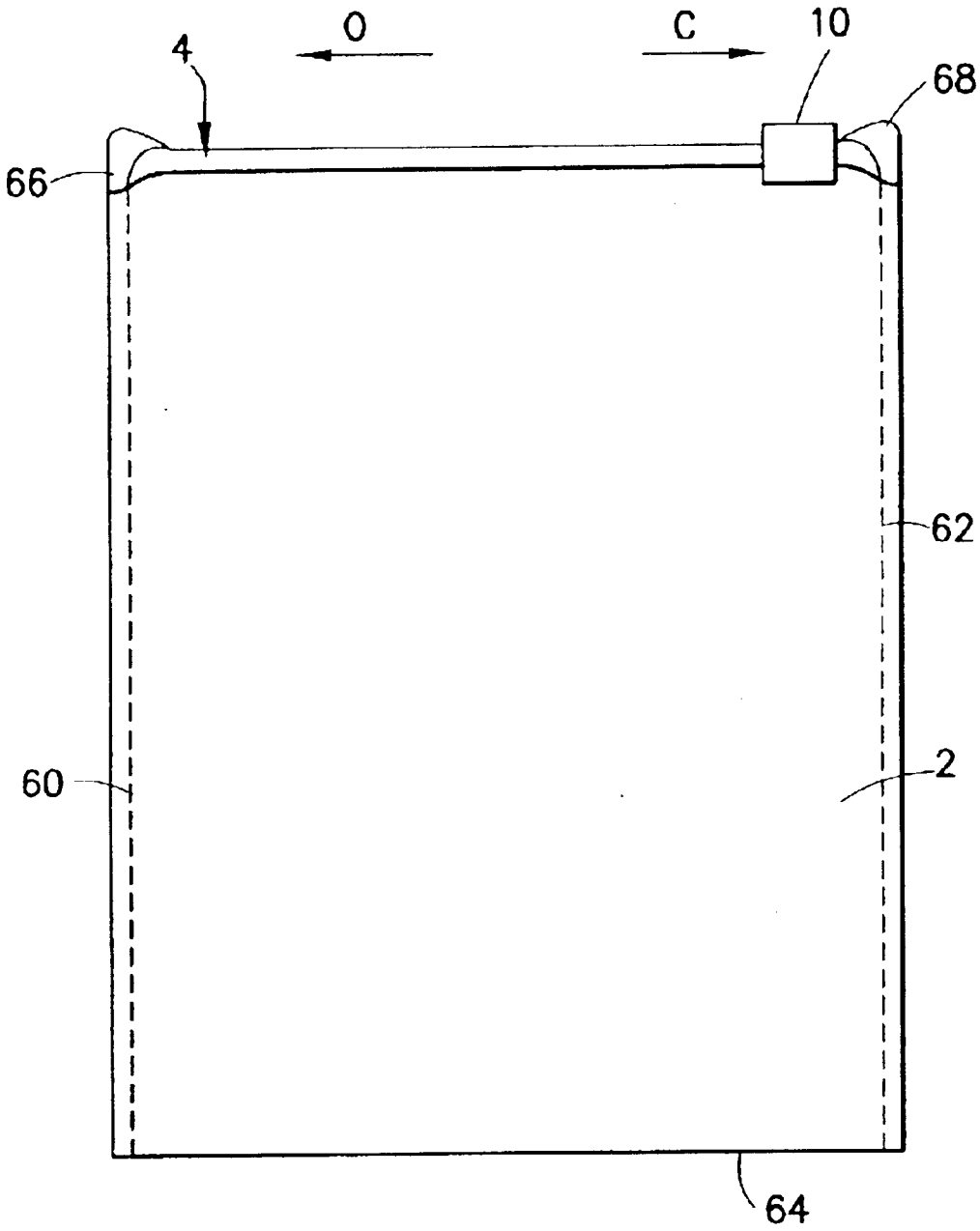
FIG. 1 is a drawing showing a reclosable package having a slider-operated zipper with formed end stops.

A reclosable package or bag 2 having a flexible plastic string zipper 4 operated by manipulation of a slider 10 is shown in FIG. 1, taken from U.S. patent application Ser. No. 10/367,450. It should be understood that the sliders disclosed herein can be utilized to actuate a zipper installed in a reclosable package or bag of the type shown in FIG. 1 or other types of reclosable packages having different structures.

The bag 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The bag 2 comprises opposing walls (only the front panel is visible in FIG. 1) that may be secured together at opposite side edges of the bag by seams 60 and 62 (indicated by dashed lines). The opposing bottoms of the walls may be joined, for example, by means of a heat seal made in conventional fashion, e.g., by application of heat and pressure. Typically, however, the bottom of the package is formed by a fold 64 in the original packaging film, as depicted in FIG. 1.

Figure 2:
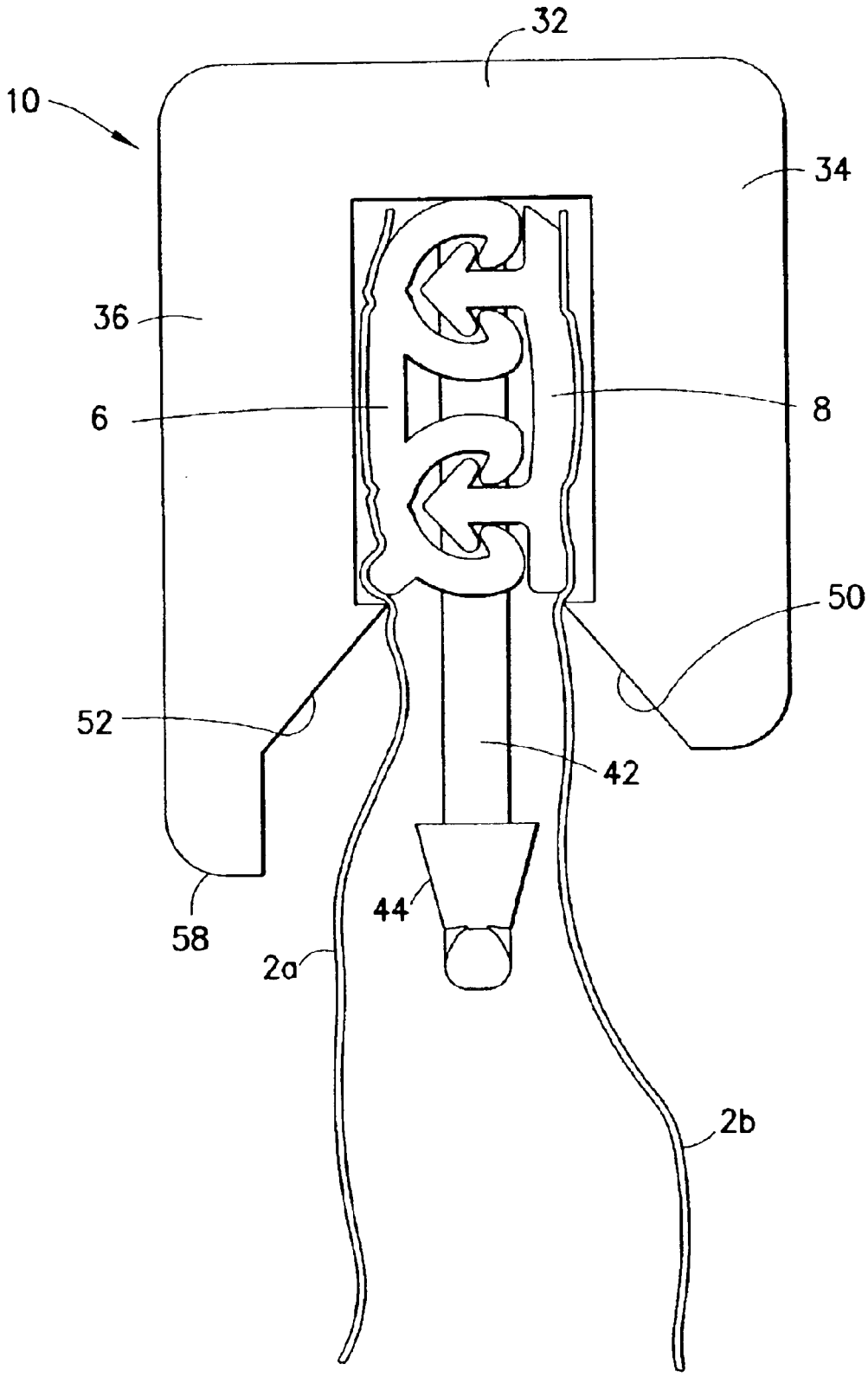
FIG. 2 is a drawing showing a partially sectioned view of a slider-string zipper assembly previously disclosed in U.S. patent application Ser. No. 10/367,450. The zipper is shown sectioned in a plane in front of the closing end of the slider.

At its top end, the bag 2 has an openable mouth, on the inside of which is an extruded plastic string zipper 4. The string zipper 4 comprises a pair of interlockable zipper parts or closure strips 6 and 8 (best seen in FIG. 2). Although FIG. 2 shows a rib and groove arrangement, the profiles of the zipper halves may take any form. For example, the string zipper may comprise interlocking rib and groove elements (as shown in FIG. 2) or alternating hook-shaped closure elements. The preferred zipper material is polyethylene or polypropylene. The top edges of the front and rear bag walls 2*a* and 2*b* (see FIG. 2) are respectively sealed to the backs of the zipper halves 6 and 8 by a conventional conduction heat sealing technique.

The string zipper is operated by sliding the slider 10 along the zipper parts. As the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The bag shown in FIG. 1 further comprises end stops 66 and 68 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment of the type disclosed in U.S. patent application Ser. No. 10/113,489, entitled "Method and Apparatus for Ultrasonically Stomping Slider End Stops on Zipper". The horn and anvil of the ultrasonic welding apparatus disclosed therein are specifically designed so that the ultrasonic stomping operation create a vertical hump on the zipper to stop the slider, while at the same time preserving the base of the zipper profile to resist pull-off of the slider. Sufficient heat penetrates into the mass of the zipper profile in the end stop areas to fuse the zipper parts together, posing an obstacle to the slider plow. Also, a V-shaped notch can be formed in one end or both ends of the slider top wall for receiving the vertical hump of respective formed end stops. This allows the plow to abut against the fused end of the zipper in the zipper fully closed state.

In accordance with one embodiment of the present invention, the zipper halves 6 and 8 comprise interlocking rib and groove elements, which are well known in the art. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements.

Figure 3:
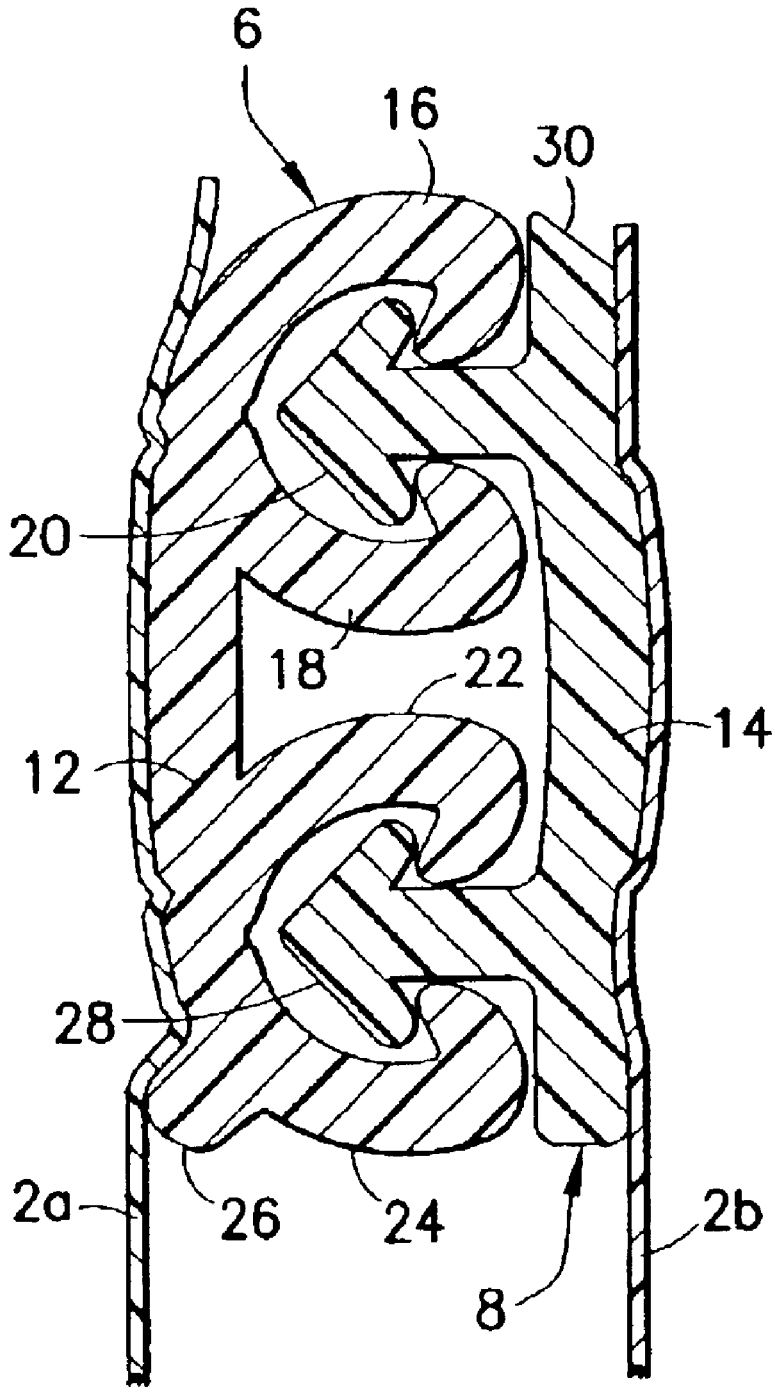
FIG. 3 is a drawing showing a sectioned view of the string zipper incorporated in the assembly depicted in FIG. 2.

One embodiment of a string zipper suitable for use with the slider of the present invention is seen in FIG. 2 and is shown in greater detail in FIG. 3. Numerals 2*a* and 2*b* indicate opposing walls (made, e.g., of plastic film) of a receptacle. The walls 2*a* and 2*b* of the receptacle are joined to the zipper parts 6 and 8, e.g., by heat sealing. The zipper in this example is an extruded plastic structure comprising mutually interlockable profiled zipper parts 6 and 8. Zipper part 8 comprises a base and two generally arrow-shaped rib-like male closure elements or members 20 and 28 projecting from a base 14, and two pairs of hook-shaped gripper jaws connected by a sealing bridge 12. The pairs of gripper jaws form respective complementary female profiles for receiving the male profiles of closure elements 20 and 28. More specifically, jaws 16 and 18 receive and interlock with the male element 20, while jaws 22 and 24 receive and interlock with the male element 28. Alternatively, one zipper part could have one male profile and one female profile, while the other zipper part has one female profile and one male profile, or the respective zipper parts could each have more than two male or female profiles.

The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively, as is best seen in FIG. 3. The upper margins of the bag film may have short free ends that extend beyond the termination points depicted in FIG. 3, provided that the free ends are not so long as to interfere with travel of the slider along the zipper or become entangled with the zipper profiles.

The end face of upper edge 30 of the base 14 that carries the male closure elements 20 and 28 is inclined at about a 45° angle to facilitate loading of the slider onto the zipper from above without snagging on a corner of the upper edge. The bottom edge 8 of the base 14 cooperates with a retaining ledge on the slider (to be described later) to increase the slider-pull-off resistance. For the same purpose, a rib 26 is formed on zipper part 6, the rib 26 cooperating with a retaining ledge on the other side of the slider.

In a typical zipper, the profile of each male member has a stem flanked by shoulders or teeth, and a tip of the profile points toward the opposing female profile, the tip being the point of the male member furthest away from the base of the profiled structure. Each female profile comprises a pair of gripper jaws extending from a base or root of the female profile. Each jaw comprises a wall and a hook integrally formed at the distal end of the respective wall. The hooks are inclined and generally directed toward each other, the distal ends of the hooks defining a mouth that communicates with a groove defined by the walls and root of the female profile.

The groove of each female profile receives the head of a respective male member when the zipper is closed, as best seen in FIG. 3. Closing of the zipper is accomplished as follows. When the male members 20 and 28 are properly aligned with and then moved into engagement with the opposing female profiles, the head of each male member will penetrate the opening in the opposing female profile. As the head of each male member penetrates, the resilient hooks of the opposing gripper jaws are pushed apart by the inclined surfaces running from the tip to the shoulders of each male member. The force exerted on the hooks of each female member by the head of the penetrating male member is transferred to the resilient walls of the gripper jaws, causing those walls to flex outwardly. The walls are flexed outward, in opposite directions, until the hooks of the female member pass by and snap into interlocking relation behind the shoulders of the male member. The heads of the male members 20 and 28 are received in the grooves of the respective female profiles and held there by the interlocked hooks, this situation constituting the closed state of the zipper.

To open the closed zipper, the zipper parts 6 and 8 are pushed apart with sufficient force by the slider plow to pry the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile.

In the prior slider-zipper assembly shown in FIG. 2, the slider 10 for opening or closing the reclosable zipper is generally shaped so that the slider straddles the zipper profiles. The upper margins of the bag walls 2*a* and 2*b*, which are joined to the backs of the zipper parts 6 and 8, are disposed between the respective zipper parts and the respective side walls of the slider.

Figure 4:
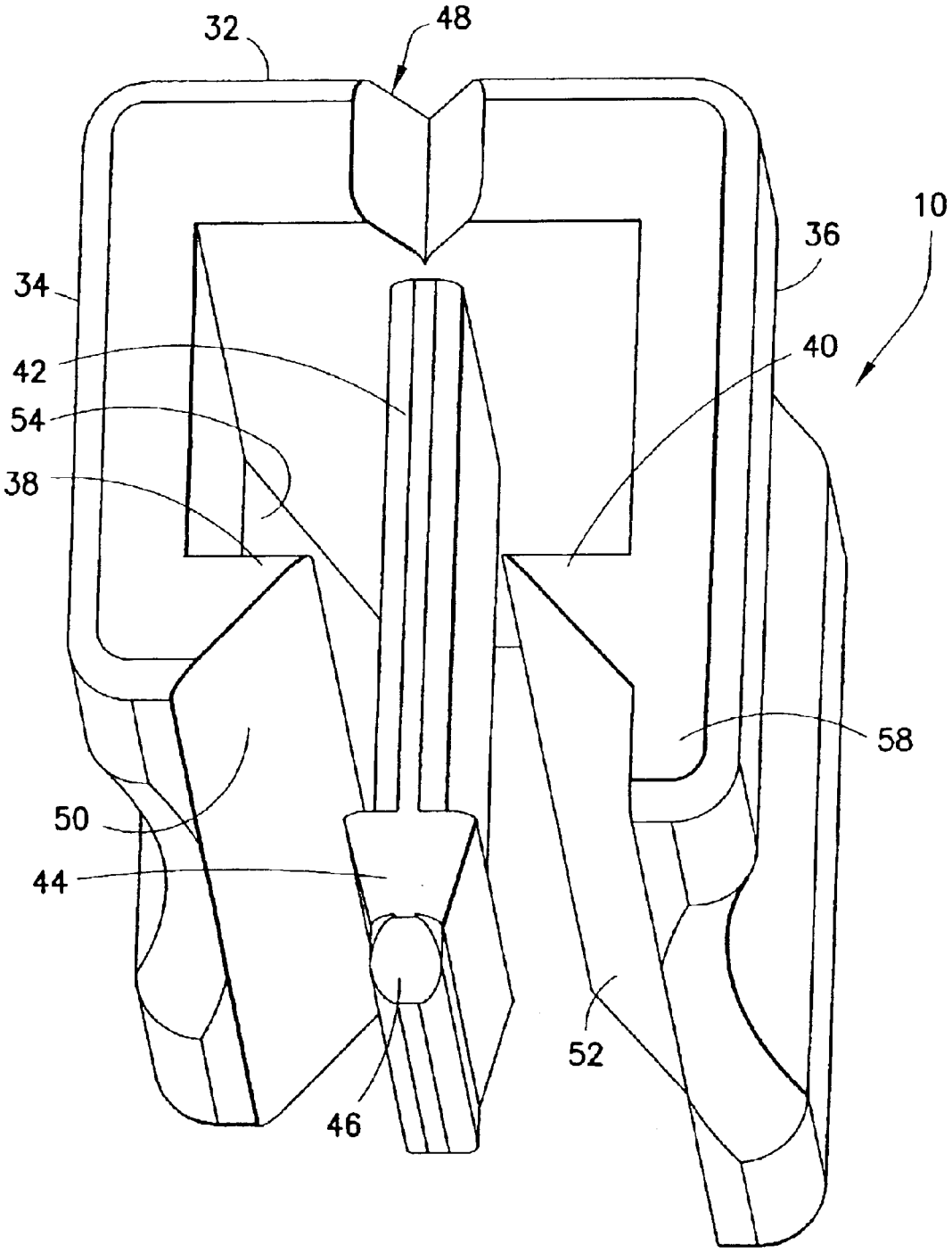
FIG. 4 is a drawing showing an isometric view of the slider incorporated in the assembly depicted in FIG. 2.

FIG. 4 (again taken from U.S. patent application Ser. No. 10/367,450) shows an isometric view of the slider incorporated in the assembly depicted in FIG. 2. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces 54 and 56 (see FIG. 8), which converge toward the closing window of the slider. The inclined surfaces 54, 56 funnel or squeeze the zipper parts toward each other, causing the zipper profiles to interlock, as the slider is moved in the closing direction. The side walls 34 and 36 are formed with concave curved indentations where the user may place the tips of an index finger and a thumb for gripping the slider. Alternatively, convexities (e.g., ribs) could be formed on the sides of the slider to facilitate grasping.

The slider 10 also comprises a plow or divider 42 that depends downward from a central portion of the top wall 32 to an elevation below the lowermost portions of each side wall. The plow partitions the tunnel inside the slider and is disposed between opposing sections of the zipper parts that pass through the tunnel. In the embodiment shown in FIG. 4, a wedge-shaped body 44 is disposed near the distal end of the plow 42. However, the wedge-shaped body is optional. The tip of the plow 42 is truncated and has rounded edges and flattened corners at opposing ends for facilitating insertion of the plow between the zipper profiles without snagging.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6 and 8 apart. The plow 42 divides the closing end of the slider tunnel into respective passages for the separated zipper parts to pass through.

The slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 may have substantially coplanar, generally horizontal upper surfaces on which the bottom edges of the zipper profiles can sit, thereby effectively latching the slider under the bottom edges of the zipper parts to increase slider pull-off resistance. Alternatively, the upper surfaces of the ledges may be angled upward to aid in gripping.

The ledges 38 and 40 further comprise respective inclined bottom surfaces that extend downward and outward from the respective inner edges of the generally horizontal surfaces. The inclined surfaces 50 and 52 are each substantially planar, with the respective planes of these inclined surfaces intersecting at a line inside the tunnel that is parallel to the longitudinal axis of the slider. The inclined surfaces 50 and 52 serve to guide the respective zipper parts 6 and 8 into the slider tunnel during insertion of the slider onto the zipper, e.g., by vertical descent from a position above an open section of the upright zipper. The sliders are typically inserted at spaced intervals onto a bag with string zipper that is intermittently advanced in a machine direction on automated slider insertion equipment.

Systems for transporting sliders to a slider insertion device are disclosed in U.S. patent application Ser. No. 10/106,687 (incorporated by reference herein) filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIG. 4 has one leg (i.e., side wall) longer than the other, to wit, an extension 58 of side wall 36 projects to an elevation lower than the bottom edge of the opposing side wall 34 (e.g., see FIG. 5). The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

In addition, a single V-shaped notch may be formed at one end or a pair of V-shaped notches 48 may be formed at opposite ends of the top wall 32 of the slider. These notches receive a portion of the vertical hump of a respective slider end stop, as previously explained. Thus, the notches allow the slider to travel further into the stomped or presealed areas. In the case of the zipper-closed park position of the slider, the notch at the opening end of the slider reduces the size of the open area of the zipper between the plow and the end stop. In the case of the zipper-open park position of the slider, the notch at the closing end of the slider increases the length of the open mouth section by the length of the notch.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The present invention is a slider that improves upon the design depicted in FIG. 4. One aspect of the improvement is that less material is needed to make the sliders of the present invention as compared to the slider depicted in FIG. 4. Another aspect of the improvement is that the sliders disclosed herein can be injection molded at higher speeds, thereby decreasing per unit cost.

Figure 5:
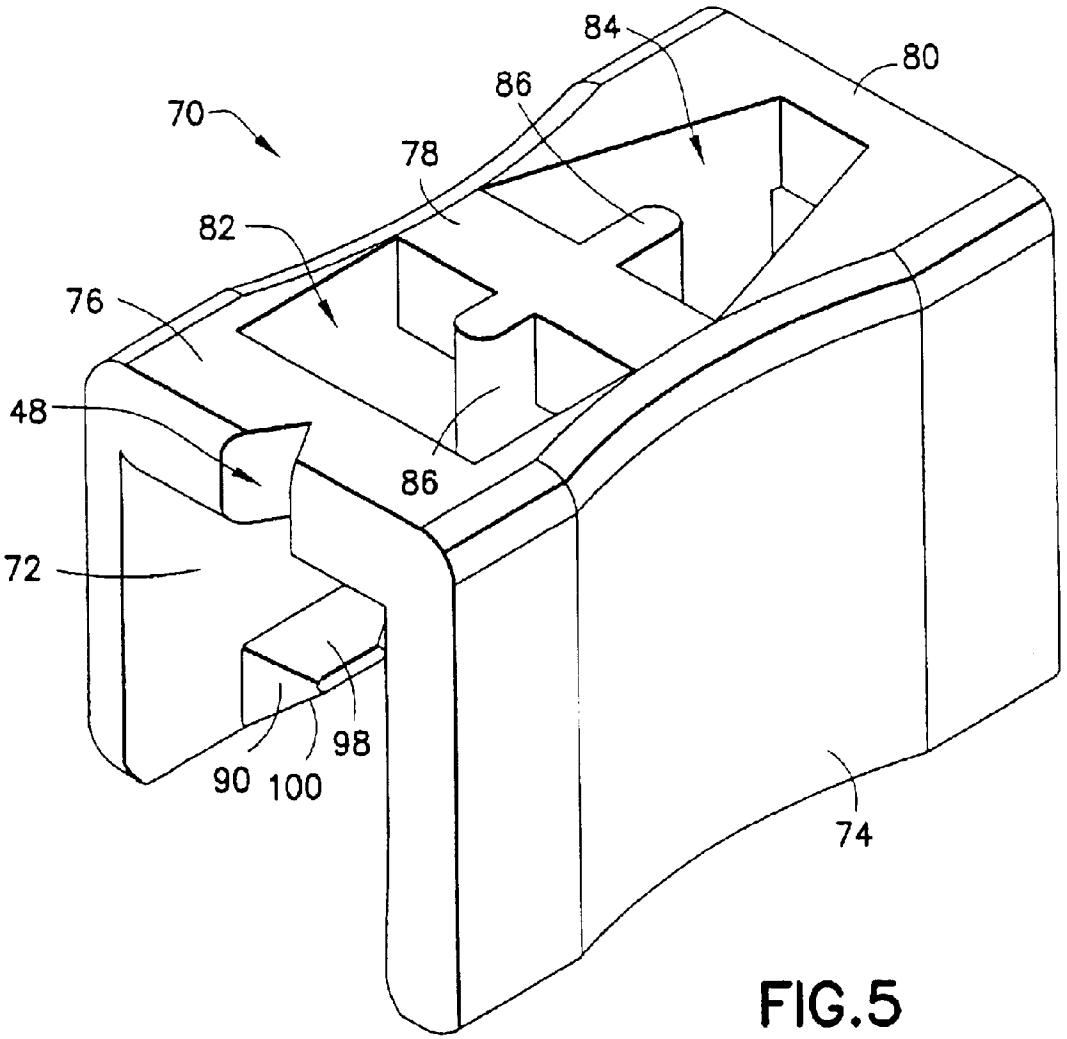
FIGS. 5–7 are drawings showing respective isometric views from three different angles of a slider in accordance with one embodiment of the present invention.
Figure 6:
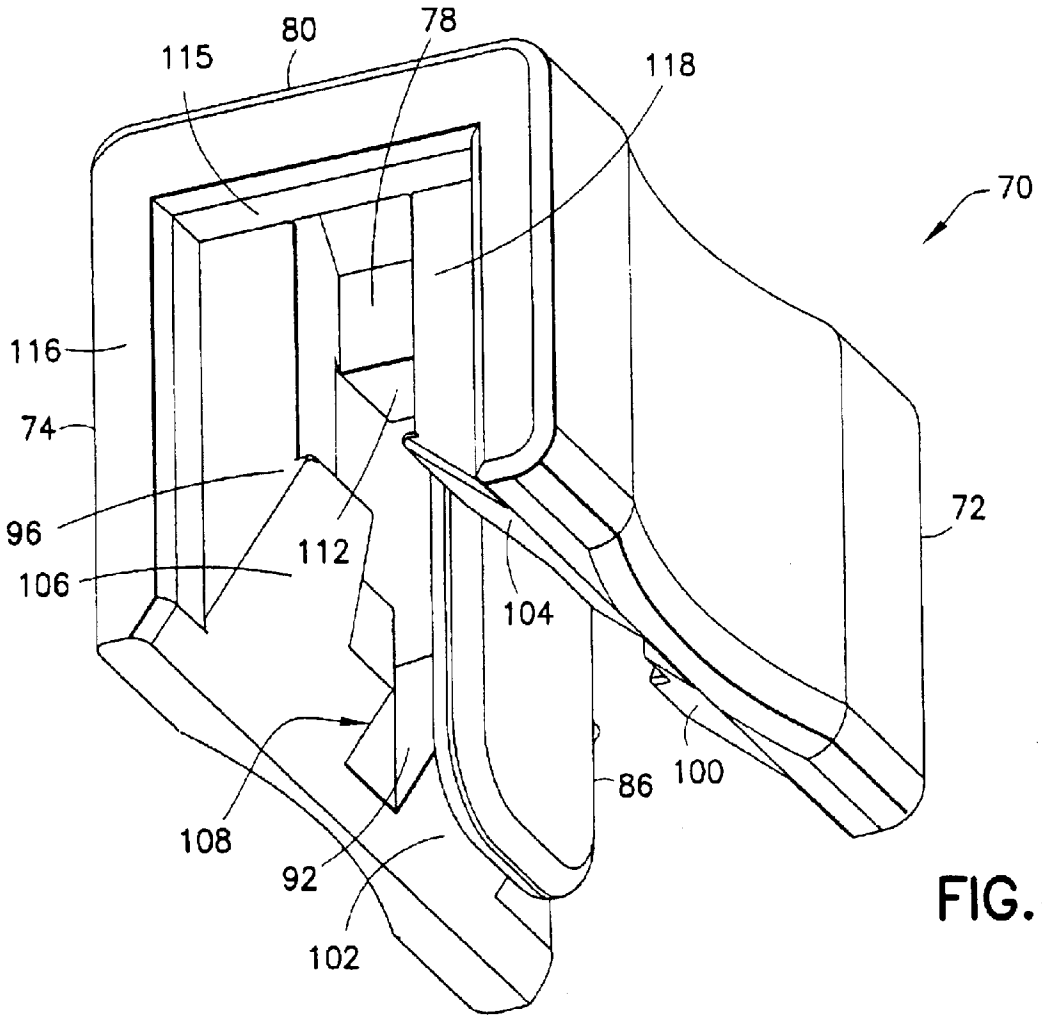
Figure 7:
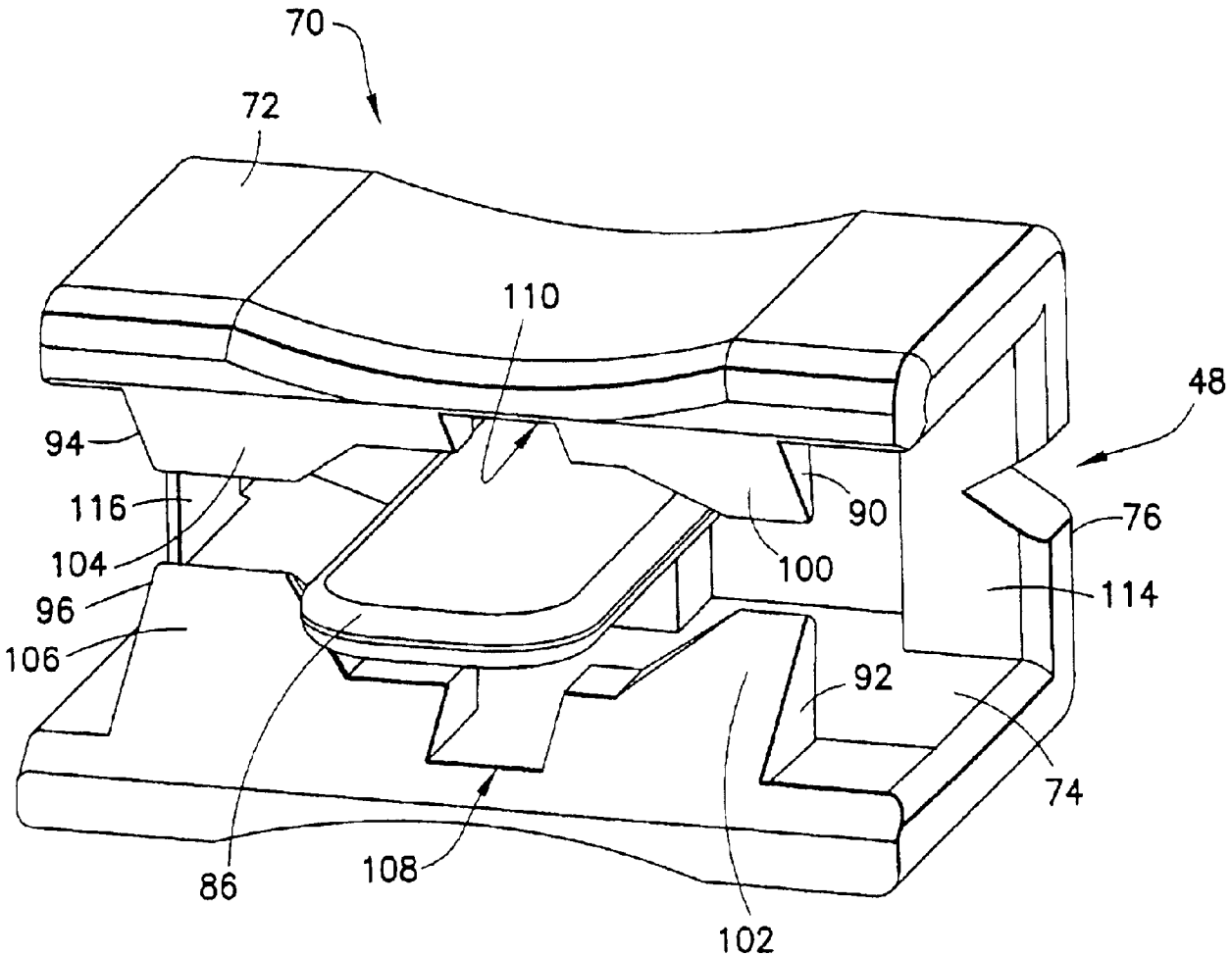

A molded slider 70 in accordance with a first embodiment of the present invention is depicted in FIGS. 5–7. The slider 70 comprises a pair of spaced-apart side walls 72 and 74 that form a passageway therebetween, and three cross beams or bridging members 76, 78 and 80 that span the passageway, each cross beam having one end connected to side wall 72 and the other end connected to the side wall 74. As best seen in FIG. 5, the side wall 74 extends to a depth greater than the depth of the other side wall 72. In other words, if the slider were placed upside-down on a flat surface, side wall 74 would extend to a height greater than the height of side wall 72. In the specific example depicted in FIG. 5, each side wall has a respective concave surface that has a constant curvature in the elevational direction. These depressions on opposing sides of the slider facilitate grasping of the slider by the consumer.

The cross beam 76 is disposed at the opening end of the slider, while the cross beam 80 is disposed at the closing end of the slider. The cross beam 76 has a V-shaped notch 48 as shown for receiving part of a slider end stop. The cross beam 78 is disposed in or near the middle of the slider. The cross beams 76, 78 and 80 may have the same height and be disposed at the same elevation, i.e., at the top of the slider. The side walls 72, 74 both depend downward generally perpendicular to the plane of the cross beams. The slider 70 is made by an injection molding process, meaning that the cross beams are integrally formed with the side walls.

To facilitate injection molding, the top of the slider is designed with two mold cutouts 82 and 84, best seen in FIG. 5. These cutouts are formed by the mold tooling that also forms the horizontal upper surfaces of the retaining ledges (e.g., surface 98 of retaining ledge 90, which is visible in FIG. 5). The cutout 82 is bounded by the cross beams 76, 78 and by mutually parallel interior surfaces of the side walls 72, 74 in a portion of the slider where the zipper (not shown) is open, while the cutout 84 is bounded by the cross beams 78, 80 and by mutually converging interior surfaces of the side walls 72, 74 in a portion of the slider where the zipper is being closed.

The slider 70 further comprises a plow 86 (best seen in FIGS. 6 and 7) disposed between side walls 72, 74 in a generally central position that partitions the passageway between the side walls. The plow 86 is connected to and depends downward from the cross beam 78. In this embodiment, the plow 86 plow is generally tongue-shaped and has an elongated cross-sectional profile with rounded ends. Its profile is generally constant along a majority of the length of the plow. The plow 86 extends downward beyond the bottom edges of the side walls 72, 74. The zipper parts inside the slider passageway are disengaged except at the closing end of the slider, with the plow 86 intervening between the zipper parts. The generally vertical leading and trailing edges of the plow are disposed forward and rearward of the cross beam 78. The terms "leading" and "trailing" are used herein with reference to the situation when the slider is moving in a zipper opening direction. As the slider is moved along the zipper in the zipper opening direction, the generally vertical "leading" edge of the plow 86 will pry the oncoming engaged zipper parts apart.

The slider 70 further comprises four retaining ledges that latch under the zipper parts and assist in retaining the slider of the zipper. The retaining ledges are formed as two pairs of mutually opposing projections, one pair of retaining projections being disposed on one side of the cross beam 78 in the area where the side walls 72, 74 are generally mutually parallel, while the other pair of retaining projections is disposed on the other side of the cross beam 78 in the area where the side walls 72, 74 converge. In other words, one pair of retaining ledges (90 and 92 described in detail below) latches the opening end of the slider to an open zipper section, while the other pair of retaining ledges (94 and 96 described in detail below) latches the closing end of the slider to a closed zipper section.

The retaining ledge 90 (shown in FIG. 5) is integrally formed on the interior of the side wall 72 and projects into the slider passageway. The retaining ledge 90 has a generally horizontal planar top surface 98 and an inclined planar surface 100, which surfaces meet at a linear juncture at the tip of the retaining ledge 90. Similarly, the opposing retaining ledge 92 (shown in FIG. 7) is integrally formed on the interior of the side wall 74 and projects into the slider passageway and toward the retaining ledge 90. The retaining ledge 92 has an inclined planar surface 102 and a generally horizontal planar top surface (not visible in FIG. 7), which surfaces meet at a linear juncture at the tip of the retaining ledge 92. The generally horizontal top surfaces of the retaining ledges 90 and 92 may be generally coplanar. Retaining ledges 90 and 92 lie entirely under the cutout 82, and no portion of either cross beam 76 or cross beam 78 overhangs either of the retaining ledges 90 and 92.

The retaining ledge 94 (shown in FIG. 6) is integrally formed on the interior of the side wall 72 in the convergent section and projects into the slider passageway. The retaining ledge 94 has a horizontal planar top surface (not visible in FIG. 6) generally coplanar with surface 98 of ledge 90 and an inclined planar surface 104, which surfaces meet at a linear juncture at the tip of the retaining ledge 90. Similarly, the opposing retaining ledge 96 (shown in FIG. 7) is integrally formed on the interior of the side wall 74 and projects into the slider passageway and toward the retaining ledge 94. The retaining ledge 96 has an inclined planar surface 106 and a generally horizontal planar top surface (not visible in FIG. 7), which surfaces meet at a linear juncture at the tip of the retaining ledge 96. The generally horizontal top surfaces of the retaining ledges 94 and 96 may be generally coplanar. Retaining ledges 94 and 96 lie entirely under the cutout 84, and no portion of either cross beam 76 or cross beam 78 overhangs either of the retaining ledges 94 and 96.

The generally horizontal top surfaces of the retaining ledges 90, 92, 94, 96 latch under the zipper profiles and assist in retaining the slider on the zipper, while the inclined bottom surfaces 100, 102, 104, 106 of the retaining ledges assist in slider insertion onto the zipper by guiding or funneling the respective zipper parts into the slider passageway, including the passages on opposing sides of the plow 86. To aid in gripping, the top surfaces may be inclined upward toward the tip of each ledge.

The slider 70 is designed for injection molding in a die consisting of two tool parts, one stationary and one movable. The cutouts 82 and 84 may be formed by the movable die part. Disregarding the portions of plow 86 that project into the mold cutouts 82, 84, the cutout 82 is generally rectangular, while the cutout 84 is generally trapezoidal. Preferably, for the sake of simplifying the mold tooling, the movable die part will have respective projections of constant profile along a majority of their lengths, at least to the elevation of the coplanar horizontal surfaces of the retaining ledges, with appropriate recesses for receiving injected plastic material to form those respective portions of plow 86 that project forward and rearward of the cross beam 78. The movable die part will have respective horizontal surfaces for forming the horizontal top surfaces of the four retaining ledges. It should be understood that this movable die part will be displaced vertically upward to remove it from the molded slider after curing. While the cutouts 82 and 84 are the result of the above-described injection molding process, their presence has the added benefit of reducing the mass of the slider, thereby reducing material costs.

Conversely, the bottom or undersurfaces of the cross beams and the inclined bottom surfaces of the retaining ledges may be formed by the stationary die part. Referring to FIG. 6, a mold cutout 108 must be formed between the retaining ledges 92 and 96 and under one side of the cross beam 78; referring to FIG. 7, a mirror-image mold cutout 110 must be formed between the retaining ledges 90 and 94 and under the other side of the cross beam 78. These cutouts 108 and 110 allow access for the stationary die tooling to form the undersurfaces 112 (one of which is shown in FIG. 6) of cross beam 78 on both sides of the plow 86. Since the retaining ledges 90, 92 do not extend into the space underlying the cross beam 76 (as seen in FIG. 7), and the retaining ledges 94, 96 do not extend into the space underlying the cross beam 80 (as seen in FIG. 6), the stationary die tooling also has access for forming the respective undersurfaces 114, 115 of cross beams 76 and 80.

The cured slider can be removed from the cavity in the stationary die part by vertical displacement upward. Because the slider design has eliminated confronting horizontal interior surfaces, the slider can be injection molded using only two die parts. This increases the speed of the automated injection molding machine as compared to injection molding processes that require the insertion of a third mold tool from the side for the purpose of forming confronting horizontal interior surfaces.

In the alternative, the mold could be designed to form the slider in an upside-down state, wherein the cutouts 82 and 84 would be formed by the stationary die part, and the cutouts 108 and 110 would be formed by the movable die part.

Figure 8:
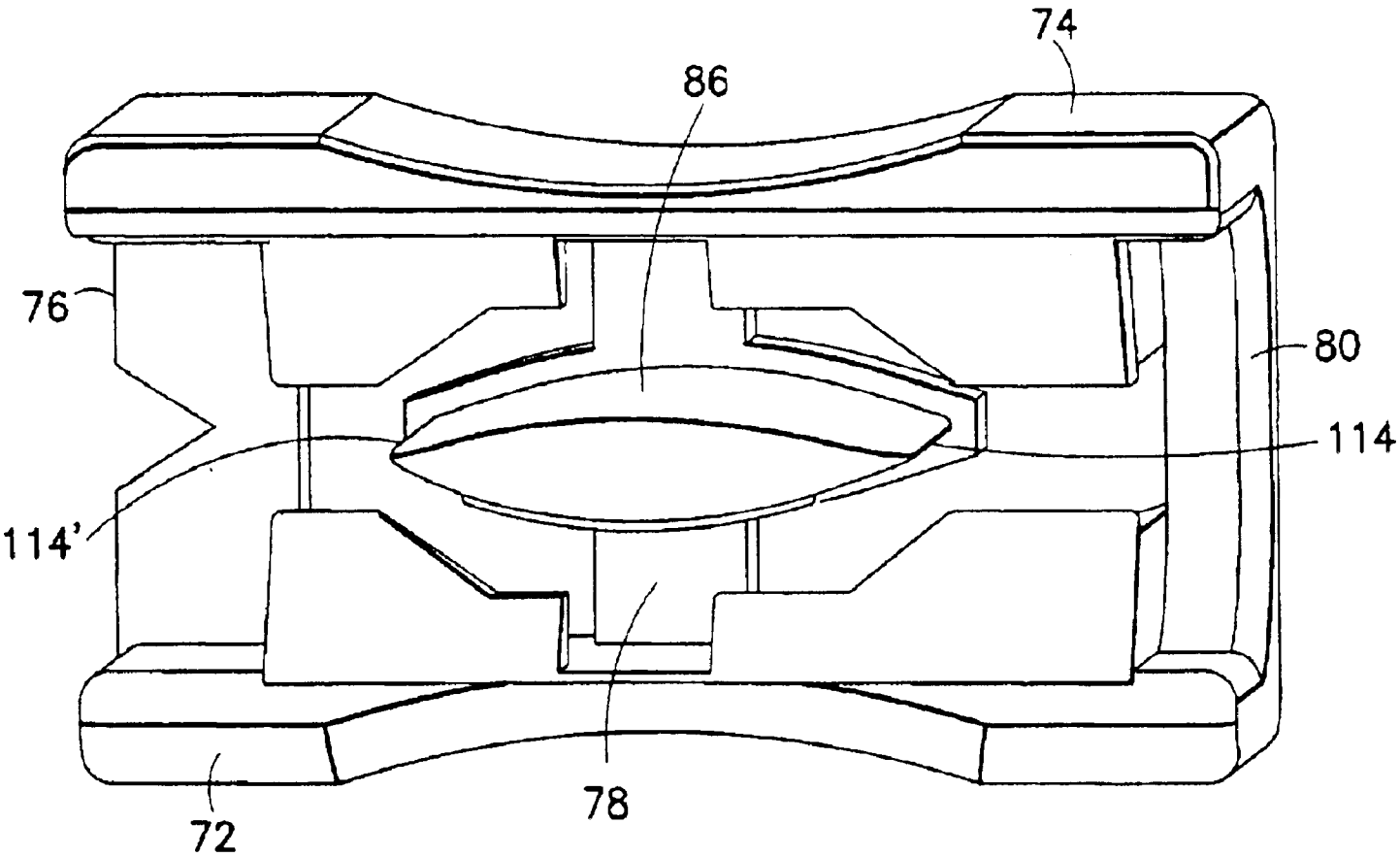
FIG. 8 is a drawing showing an isometric view of a slider in accordance with another embodiment of the invention.

A slider in accordance with an alternative embodiment of the invention is shown in FIG. 8. This slider differs from the slider shown in FIGS. 5–7 in the shape of the cross-sectional profile of the plow. Instead of rounded leading and trailing edges, the plow 86 has tapered edges 114 and 114' that narrow in width, so that the leading and trailing plow edges can fit more snugly into the spaces on either side of the plow formed by the partially spread zipper parts when the zipper is fully closed. When the plow edges are rounded, a respective pinhole can be seen at each edge of the plow. These pinholes are due to the mismatch between the round profile of the plow edge as compared to the V-shaped space where the zipper parts start to spread apart. The end result is excessive air leakage into the bag. The amount of air leakage can be reduced by tapering the edges of the plow, thereby providing a better fit with the V-shaped spaces that are present at the loci of initiation of the zipper parts being spread apart in order to pass around the plow.

Figure 9:
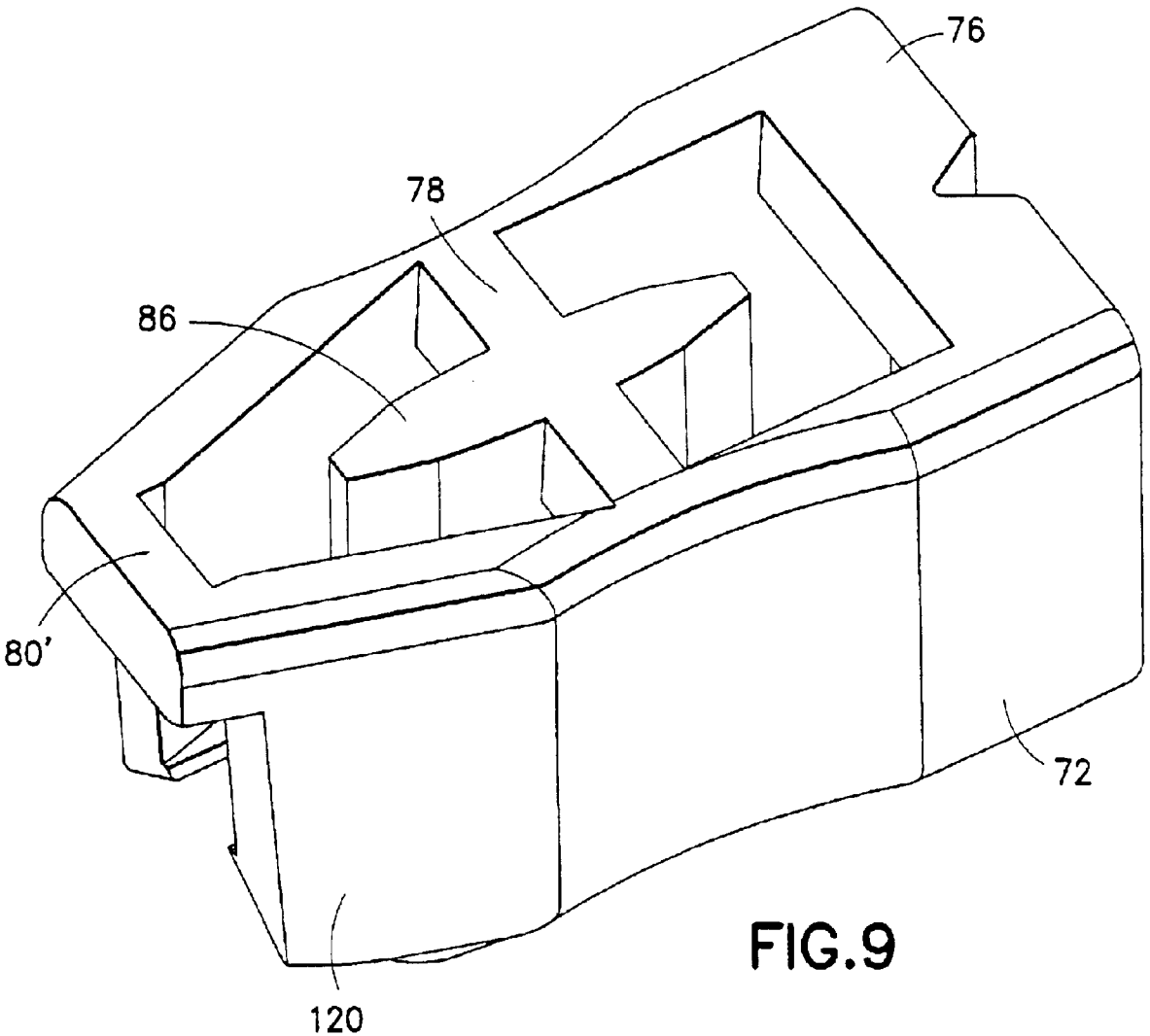
FIGS. 9 and 10 are drawings showing respective isometric views of a slider in accordance with a further embodiment of the invention.
Figure 10:
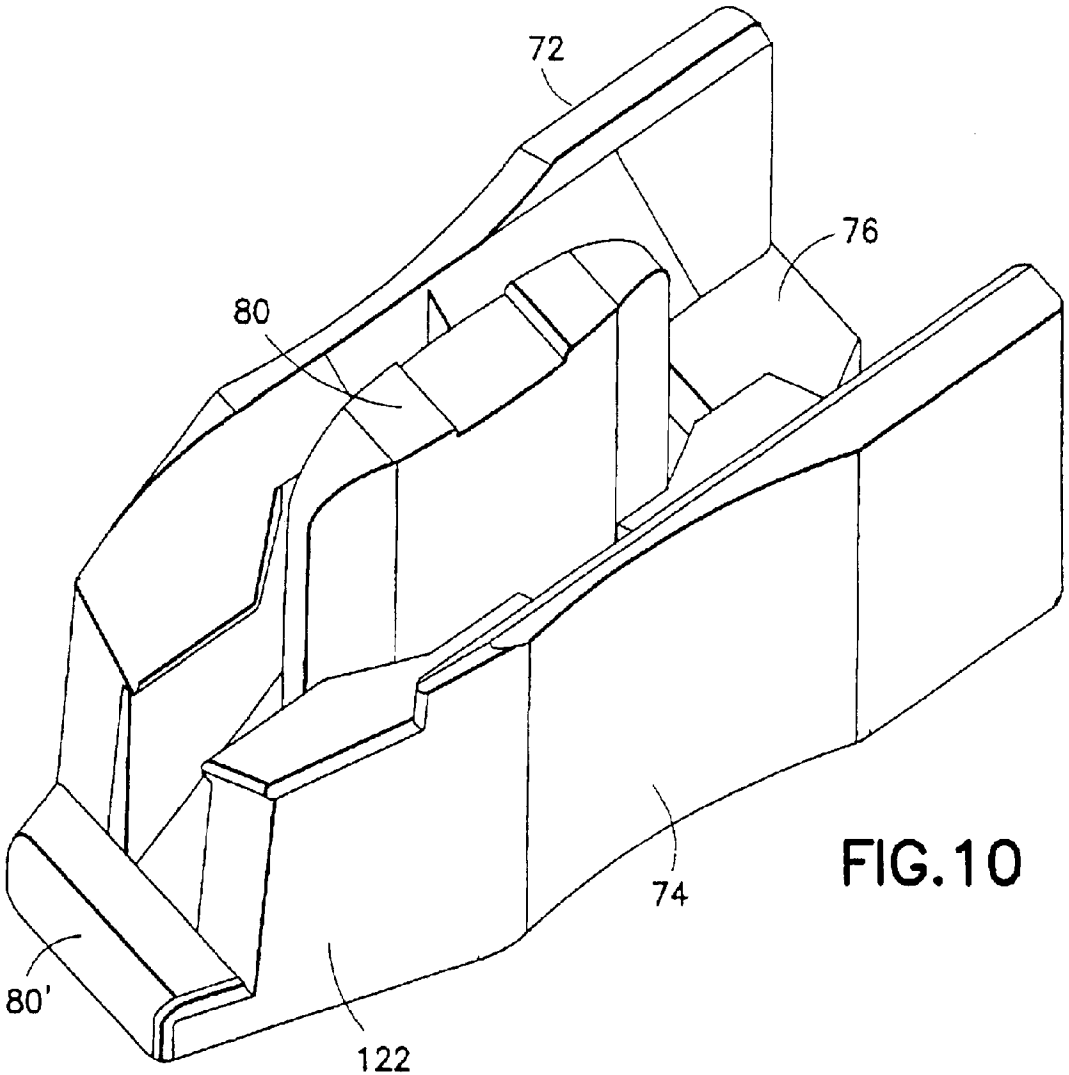

A slider in accordance with another embodiment of the invention is illustrated in FIGS. 9 and 10. This slider was designed with reduction of material cost in mind. In the embodiment seen in FIG. 6, the closing end of the slider comprises some extra material that is not essential to proper functioning of the slider. In particular, it has been discovered that the vertical columns, designated by numerals 116 and 118 in FIG. 6, can be eliminated along their entire height, including at the upper corners, leaving an abbreviated cross piece 80' that projects in cantilever fashion forward of the closing end of the slider, as depicted in FIGS. 9 and 10. Further plastic material is saved by forming inclined outer surfaces 120 (shown in FIG. 9) and 122 (shown in FIG. 10) on the exterior of the closing end of the slider. Thus, the slider depicted in FIGS. 9 and 10 is inherently cheaper to manufacture because it requires less plastic material. Also a more uniform part reduces injection mold cycle time (no pressure drop while injecting).

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" includes bags, pouches, and any other type of packaging in which a flexible plastic zipper can be incorporated. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions. As used in the claims, the term "cutout" means an opening and should not be construed as the result of a cuffing operation since the sliders of the disclosed embodiment are molded.

What is claimed is:

1. A reclosable package comprising a receptacle having a mouth, a zipper joined to said receptacle at said mouth and a slider comprising first and second side walls spaced apart to define a passageway therebetween; a first cross beam connecting said first side wall to said second side wall and disposed at one end of said slider; a second cross beam connecting said first side wall to said second side wall and spanning said passageway in a zone intermediate to the ends of said slider; a third cross beam connecting said first side wall to said second side wall and disposed at the other end of said slider; a plow connected to and depending from said second cross beam, said plow partitioning said passageway in said intermediate zone of said slider; a first retaining ledge projecting from said first side wall into said passageway; a second retaining ledge projecting from said second side wall into said passageway; a third retaining ledge projecting from said first side wall into said passageway; and a fourth retaining ledge projecting from said second side wall into said passageway, wherein a first cutout in the top of said slider communicates with said passageway, said first cutout being bounded at least in part by respective first portions of said first and second side walls, a portion of said first cross beam, and a first portion of said second cross beam, said first and second retaining ledges being disposed entirely under said first cutout with no portion of said first and second cross beams overhanging any portion of said first and second retaining ledges, wherein a second cutout in the top of said slider communicates with said passageway, said second cutout being bounded at least in part by respective second portions of said first and second side walls, a portion of said third cross beam, and a second portion of said second cross beam, said third and fourth retaining ledges being disposed entirely under said second cutout with no portion of said second and third cross beams overhanging any portion of said third and fourth retaining ledges, and wherein said zipper comprises first and second mutually interlockable zipper parts that pass through said passageway and are separated by said plow, said slider being latched to adjacent portions of said first and second zipper parts by said first through fourth retaining ledges.

2. The package as recited in claim 1, wherein said second side wall has a height greater than the height of said first side wall.

3. The package as recited in claim 1, wherein said plow projects downward beyond the bottom edges of said first and second side walls.

4. The package as recited in claim 1, wherein said plow has an elongated cross-sectional profile with tapered ends.

5. The package as recited in claim 1, wherein said first cross beam has a V-shaped notch formed therein.

6. The package as recited in claim 1, wherein said third cross beam projects forward of and leads said first and second side walls.

7. The package as recited in claim 1, wherein said plow has a length greater than a width of said second bridging member and projects both forward and rearward of said second bridging member.

8. The package as recited in claim 1, wherein said first and second side walls comprise respective interior surfaces that confront each other and converge toward the end of said slider where said first bridging member is disposed.

9. The package as recited in claim 1, wherein said first and second side walls comprise respective interior surface areas that confront each other and are generally parallel in the area between said second and third cross beams.

10. The package as recited in claim 1, wherein each of said first through fourth retaining ledges comprises a respective generally horizontal surface, said generally horizontal surfaces of said first through fourth retaining ledges being substantially coplanar.

11. The package as recited in claim 10, wherein each of said first and second retaining ledges comprises a respective inclined surface that meets said respective generally horizontal surface of said first and second retaining ledges at a respective linear juncture, said inclined surfaces of said first and second retaining ledges being mutually convergent in a vertically upward direction.

12. The package as recited in claim 1, wherein said zipper is a string zipper, and said mouth comprises upper marginal sections of first and second walls that are joined to said first and second zipper parts, a portion of said upper marginal portion of said first wall being disposed between said first zipper part and said first side wall of said slider, and a portion of said upper marginal portion of said second wall being disposed between said second zipper part and said second side wall of said slider.

13. A reclosable package comprising a receptacle having a mouth, a zipper joined to said receptacle at said mouth and a slider comprising first and second side walls, first, second and third bridging members each having first and second ends, said first ends of said first, second and third bridging members being connected to said first side wall, and said second ends of said first, second and third bridging members being connected to said second side wall, said first, second and third bridging members generally lying in the same plane with said second bridging member disposed between said first and third bridging members, and said first and second side walls both depending downward generally perpendicular to said plane, wherein a first cutout is bounded at least in part by said first and second side walls and said first and second bridging members, while a second cutout is bounded at least in part by said first and second side walls and said second and third bridging members, a generally central plow disposed between said first and second side walls, said plow being connected to and depending downward from said second bridging member, first and second retaining ledges connected to said first side wall and projecting toward said second side wall, and third and fourth retaining ledges connected to said second side wall and projecting toward said first side wall, wherein said first and third retaining ledges are disposed entirely under said first cutout with no portion of said first and second bridging members overhanging any portion of said first and third retaining ledges, while said second and fourth retaining ledges are disposed entirely under said second cutout with no portion of said second and third bridging members overhanging any portion of said second and fourth retaining ledges, and wherein said zipper comprises first and second mutually interlockable zipper parts that are separated by said plow, said slider being latched to adjacent portions of said first and second zipper parts by said first through fourth retaining ledges.

14.The package as recited in claim 13, wherein said plow projects downward beyond the bottom edges of said first and second side walls.

15. The package as recited in claim 13, wherein each of said first through fourth retaining ledges comprises a respective generally horizontal surface, said generally horizontal surfaces of said first through fourth retaining ledges being substantially coplanar.

16. The package as recited in claim 15, wherein each of said first and second retaining ledges comprises a respective inclined surface that meets said respective generally horizontal surface of said first and second retaining ledges at a respective linear juncture, said inclined surfaces of said first and second retaining ledges being mutually convergent in a vertically upward direction.

17. The package as recited in claim 13, wherein said zipper is a string zipper, and said mouth comprises upper marginal sections of first and second walls that are joined to said first and second zipper parts, a portion of said upper marginal portion of said first wall being disposed between said first zipper part and said first side wall of said slider, and a portion of said upper marginal portion of said second wall being disposed between said second zipper part and said second side wall of said slider.

18. A reclosable package comprising a receptacle having a mouth and an assembly comprising a zipper joined to said receptacle at said mouth and a slider that actuates said zipper, said zipper comprising interlockable first and second profiled zipper parts, and said slider comprising a frame that straddles said zipper, a plow supported by said frame and separating respective sections of said first and second zipper parts, and a plurality of projections that latch under said first and second zipper parts to retain said slider on said zipper, wherein said frame comprises first, second and third bridging members, a first opening disposed between said first and second bridging members, and a second opening disposed between said second and third bridging members, said plow being connected to and depending downward from said second bridging member, wherein first and second projections of said plurality of projections are disposed entirely under said first opening with no portion of said first and second bridging members overhanging any portion of said first and second projections, and third and fourth projections of said plurality of projections are disposed entirely under said second opening with no portion of said second and third bridging members overhanging any portion of said third and fourth projections.

19. The package as recited in claim 18, wherein said frame comprises first and second side walls connected to said first through third bridging members, said plow partitioning a space between said first and second side walls, said first and third projections projecting from said first side wall, and said second and fourth projections projecting from said second side wall.

20. The package as recited in claim 19, wherein said plow projects downward beyond the bottom edges of said first and second side walls.

21. The package as recited in claim 18, wherein each of said first through fourth projections comprises a respective generally horizontal surface, said generally horizontal surfaces of said first through fourth projections being substantially coplanar.

22. The package as recited in claim 21, wherein each of said first and second projections comprises a respective inclined surface that meets said respective generally horizontal surface of said first and second projections at a respective linear juncture, said inclined surfaces of said first and second projections being mutually convergent in a vertically upward direction.

23. The package as recited in claim 18, wherein said zipper is a string zipper, and said mouth comprises upper marginal sections of first and second walls that are joined to said first and second zipper parts, respective portions of said upper marginal portions of said first and second walls being in contact with interior surfaces of said frame of said slider.

* * * * *